US006412599B1

(12) United States Patent
Thompson et al.

(10) Patent No.: US 6,412,599 B1
(45) Date of Patent: Jul. 2, 2002

(54) LOADING-DISPERSING DEVICE FOR PORTABLE NON-FREE-STANDING LADDERS

(76) Inventors: John G. Thompson, 316 E. Main St., Orange, VA (US) 22960; Wilfred L. Harris, Jr., 12129 Hidden Lakes, Culpeper, VA (US) 22701-3728

( * ) Notice: Subject to any disclaimer, the term of this patent is extended or adjusted under 35 U.S.C. 154(b) by 0 days.

(21) Appl. No.: 09/499,865

(22) Filed: Feb. 7, 2000

Related U.S. Application Data

(63) Continuation-in-part of application No. 08/910,497, filed on Aug. 4, 1997, now Pat. No. 6,021,865, which is a continuation-in-part of application No. 08/448,186, filed on May 23, 1995, now abandoned.

(51) Int. Cl.[7] ..... E04G 5/02; E06C 7/06
(52) U.S. Cl. ..... 182/107; 182/214
(58) Field of Search ..... 182/107, 214, 182/108, 129, 206

(56) References Cited

U.S. PATENT DOCUMENTS 4,754,842 A * 7/1988 Southern ..... 182/214 X
4,899,848 A * 2/1990 Parr ..... 182/214 X
5,533,591 A * 7/1996 Kiska ..... 182/214 X
6,021,865 A * 2/2000 Thompson et al. ..... 182/107

* cited by examiner

*Primary Examiner*—Daniel P. Stodola
*Assistant Examiner*—Hugh B. Thompson
(74) *Attorney, Agent, or Firm*—Sheldon H. Parker; Kimberly O. Snead

(57) ABSTRACT

A load-dispersing device for non-free standing ladders or other devices that require reduction of horizontal slippage. The single strip load-dispersing bumper can be used in combination with a ladder having side rails with a load-bearing surface. The bumper consists of a pair of flexible, resilient, load-dispersing members, each of which has a contact area and a method of affixing the members to the ladder. A first side of the contact area is placed adjacent and secured to the load-bearing surface. The second side of the contact area is placed between the load bearing surface and a support surface to prevent the ladder from sliding. The bumper can be affixed to the load bearing surface by an adhesive, tape or hook and loop material or using multiple dome-topped pins that are integral with the first side. The dome-topped pins are dimensioned to fit within holes that are placed along the load-bearing surface. A retaining clip encompasses the contact area and at least a portion of the ladder side rails to protect the end of the bumper. The retaining clip can be a soft metal having a body having a notch to receive the bumper and a pair of parallel flanges for crimping around the side rails.

20 Claims, 16 Drawing Sheets

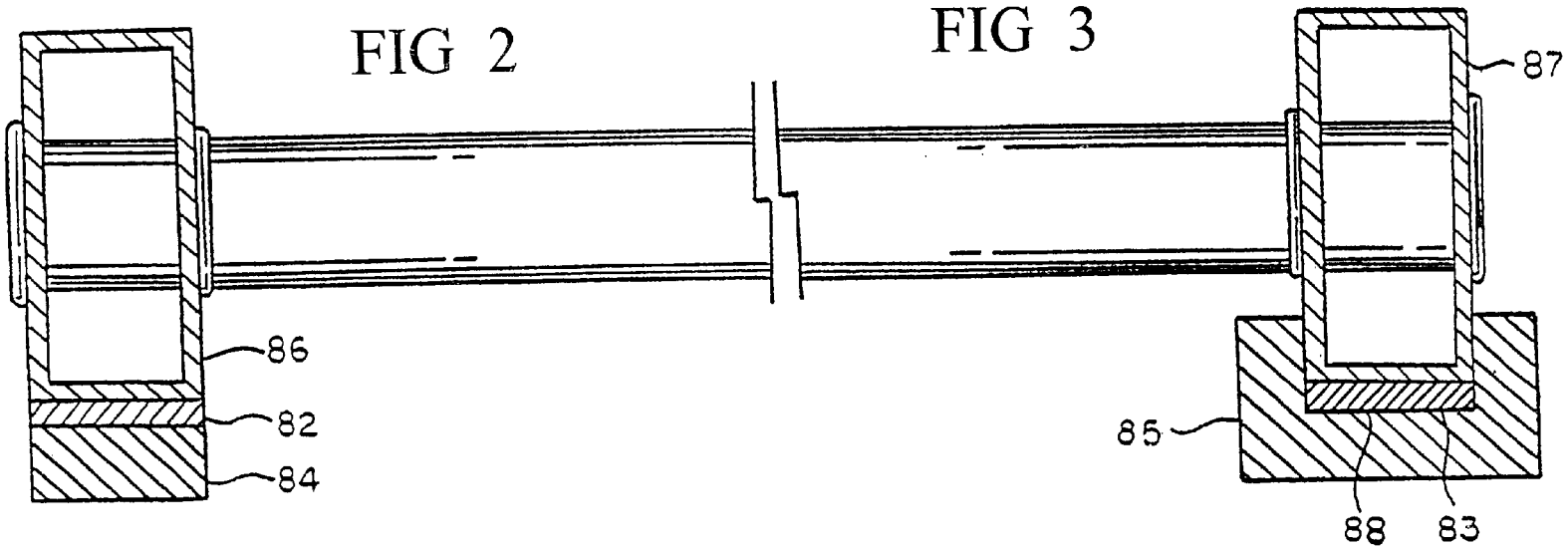
FIG 3
FIG 2
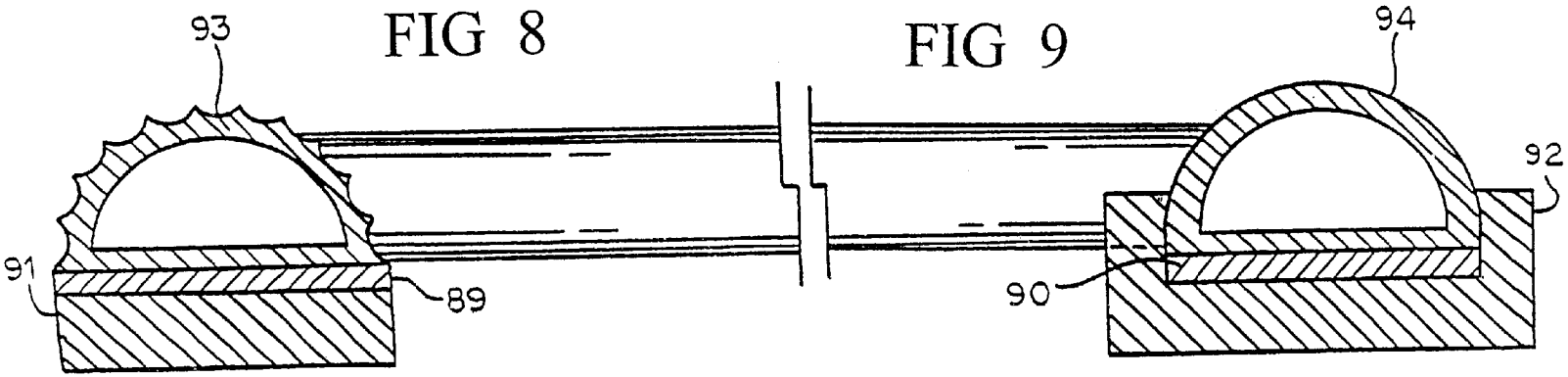
FIG 9
FIG 8

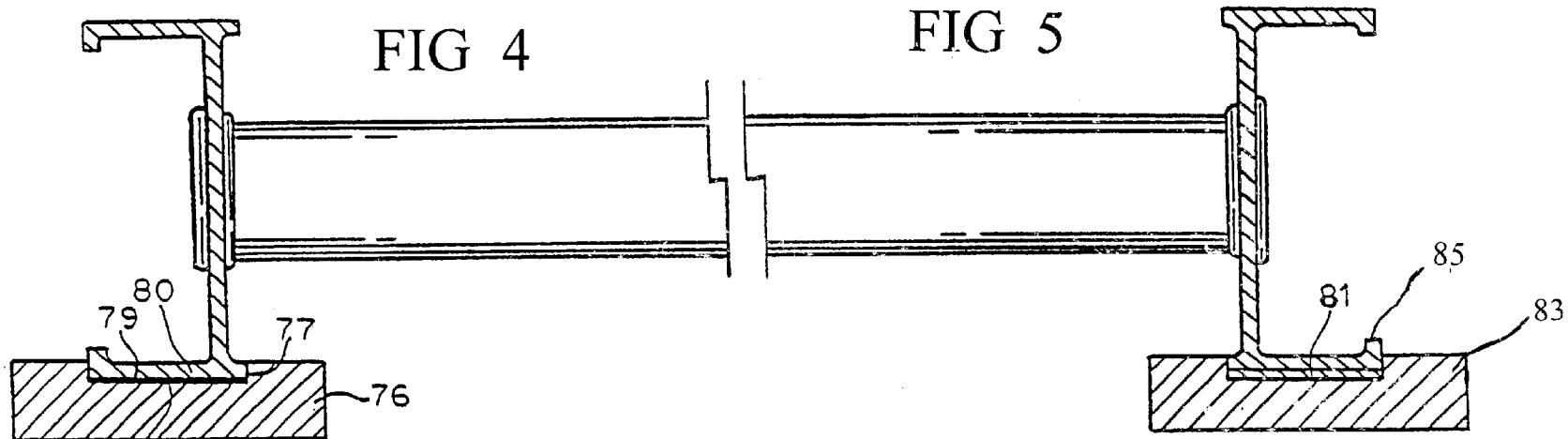
FIG 5
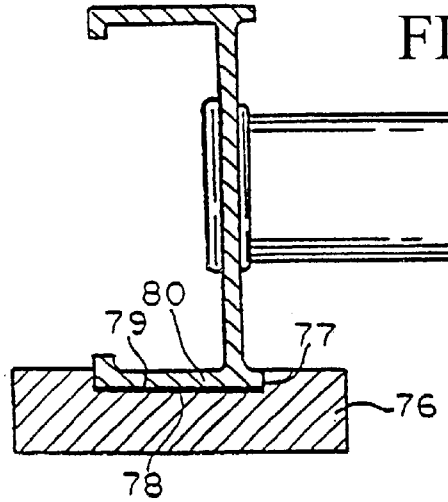
FIG 4
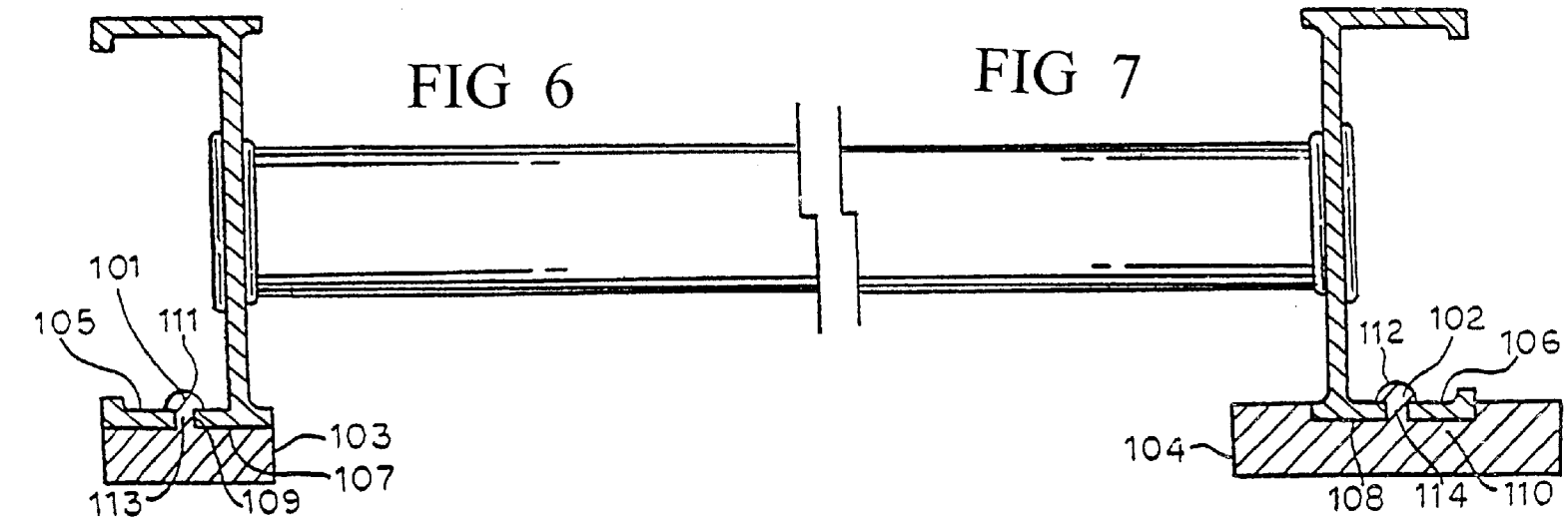
FIG 7
FIG 6

FIG 18-A

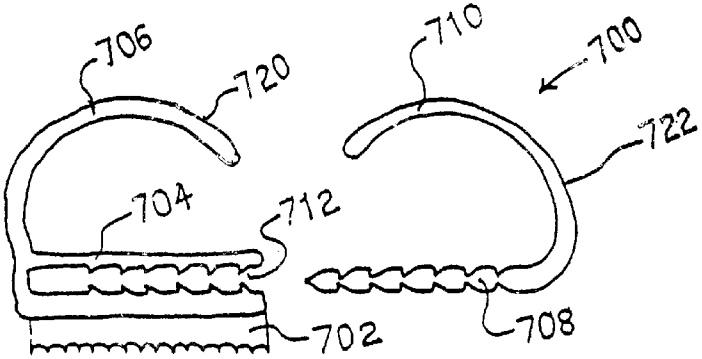
FIG 23
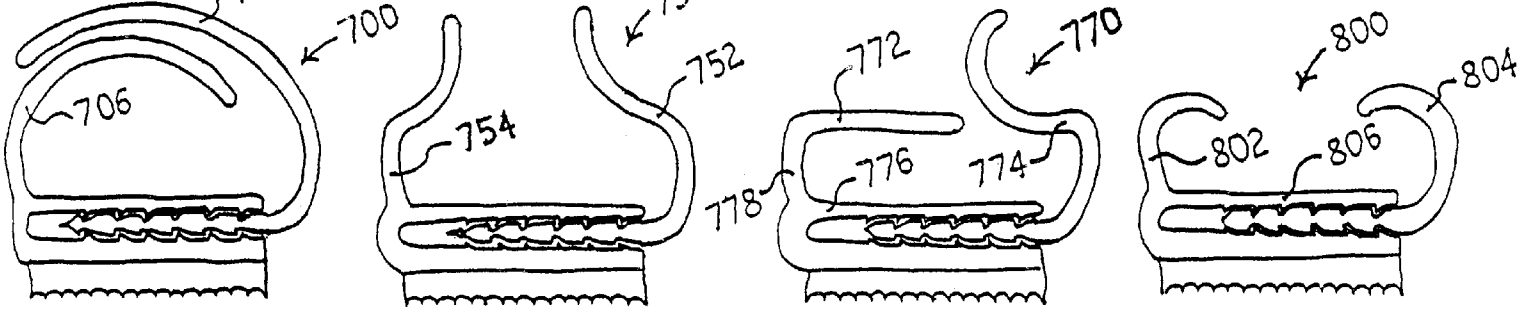
FIG 26-A
FIG 26
FIG 25
FIG 24

LOADING-DISPERSING DEVICE FOR PORTABLE NON-FREE-STANDING LADDERS

CROSS REFERENCE TO RELATED APPLICATIONS

This application is a continuation in part of U.S. Pat. No. 6,021,865, filed as application Ser. No. 08/910,497 on Aug. 4, 1997, which is a continuation in part of U.S. application Ser. No. 08/448,186 filed May 23, 1995, now abandoned, the contents of which are incorporated herein as though cited in full.

BACKGROUND OF THE INVENTION

1. Field of the Invention

The present invention generally relates to a protective, load dispersing device that prevents the slippage of a ladder as well as preventing damage to the surface against which the ladder rests. An in alternate embodiment, the protective bumpers can be used to protect one or more sides of a three dimensional object.

2. Description of the Prior Art

There are two common problems arising from the use of ladders in work on buildings, particularly on or near their roofs, which are minimized by the novel device according to this invention.

First, the thrust component of the combined weight of the ladder, the user, and any equipment the user may be carrying is commonly born by two small areas of contact between the side members of the ladder and the structure receiving the ladder. The tendency of that thrust component on the gutter is to dent it, and in the worst case to deform the edge of the gutter to the point where it collapses. As the gutter flexes, the areas of contact between the and the ladder decrease until the gutter edge supports only the corners of the undersides of the ladder. It is then that the maximum deformation of the gutter profile and the greatest damage to its paint occur. Additional damage is caused as the ladder slides against the gutter while the user is moving on the rungs.

Second, ladders have the tendency to slip sideways when there are small movements by their feet, typically caused by the feet being placed in error by the user on soft ground or on un stable propping material. Since the width of a ladder is small compared with its height, when the weight of a user of the ladder is near its top, the rate of sideways slippage accelerates the farther the line of the feet diverges from the horizontal. The prior art has addressed this problem by affixing, in some way, the upper part of the ladder to the building, roof or gutter. This solution is unsatisfactory, however, since fixing the top can require the ladder's feet to be in a location which may not be stable, and the user is then dependent for his security on the upper fixing means.

The device according to the present invention overcomes defects in the prior art by allowing the upper part of the ladder freedom of positioning both along a support surface, thereby permitting the feet of the ladder to be located on the necessary firm and level support.

All these tendencies to damage are eliminated by use of the device according to this invention, which places a flexible, non-slip, non-abrasive, non-electrically-conductive bearing surface between the ladder's side members and the gutter or other feature of the structure against which the ladder rests.

Several other patents have been granted for inventions intended to prevent ladders from slipping along their upper support surfaces, but none so far has offered a solution to the foregoing problems of damage to the upper support surface and slipping. For example, U.S. Pat. No. 3,948,353, issued to Lane, teaches an non-free-standing ladder with flanged and lined cut-out portions along the side members of its upper section, said cut-out portions being intended to hook over the upper support, with the lining providing an anti-skid surface. It can be readily seen that manufacturing the ladder claimed in Lane with its flanged cut-out portions would be more expensive than for the standard metal or Fiberglas ladder commonly available, and to which this invention is adapted, of which the side members are extruded or molded with the same cross section along their entire lengths. Furthermore, since the ladder in Lane is intended to be hooked over a fixed upper support, such as a gutter, the ladder user has a restricted opportunity of adjusting the foot of the ladder to find a stable lower support, which is a safety measure of even greater importance than any such measures taken at the upper end of the ladder, since, without a stable lower support, the ladder should not be used. Also, when the ladder is being used, that is, when weight is applied to it, any flexing of the ladder, which always occurs, and any effort of the lower end of the ladder to find a stable footing, will tend to drag down the upper support over which the ladder is hooked. This might seriously damage, for example, a light-weight aluminum gutter used as the upper support.

U.S. Pat. No. 5,121,813, issued to Funston, teaches a rigid leg member to provide stable support for the lower end of a ladder, combined with a hooking support for hooking to, for example, a gutter. A separate lower support as in Funston is not part of the present invention, which relies on the user establishing a stable footing for his ladder, and assists the user in doing this by allowing the upper support of the ladder to be adjusted up or down the length of this invention, without hooks or fixing means at the upper support. The tendency to drag the gutter down by hooked elements is the same in Funston as in Lane, in addition to which, the metal hook elements in Funston would tend to scratch the painted surface of the upper support.

U.S. Pat. No. 4,924,971, issued to Rice; U.S. Pat. No. 4,601,365, issued to Davis; and U.S. Pat. No. 4,580,661, issued to Thomson, Jr., all teach inventions that require installation on or in the upper support, which in the cases of Davis and Thomson, Jr. appear to be restricted to gutters. To an extent the initial installation negates the purpose of their devices, since the ladder must be used initially to install the securing methods. This contrasts with the benefits of the present invention, where the safety device is installed on the ladder before use and requires no fixing to the upper or lower ladder support surface. The present invention also enables a non-free-standing ladder to be lengthened or shortened, and moved along the support surface, without adjustment of the device. In the case of Rice, the invention must be reinstalled at the upper support for each new location in order for the ladder to be moved; in the cases of Davis and Thompson, Jr., the inventions must be moved when the ladder is moved, or additional devices installed at the new locations.

U.S. Pat. No. 5,293,958, issued to Swiderski et al., and U.S. Pat. No. 4,754,842, issued to Southern both teach devices for propping the tops of ladders away from walls. This feature enables a ladder user to work up to the level of the top of a wall or possibly slightly above, but does not permit the user safely to step off the ladder on to the roof of a structure. By contrast, the present invention enables the user to safely step from the ladder to the roof since the ladder rests against lower edge of the roof, while reducing the possibility of the ladder's slipping sideways.

U.S. Pat. No. 4,974,699, issued to Boring, U.S. Pat. No. 4,726,446, issued to Perbix, and U.S. Pat. No. 4,469,194, issued to McBride, all teach attachments to the upper end of a ladder, intended to rest against a vertical wall. They are therefore not adapted to the purpose of allowing the user to step from the ladder on to the roof of the walled structure. The devices taught by Boring, Perbix and McBride would be difficult to align with a roof edge from a position at the bottom of the ladder, because of their short length. Because of their configurations, Boring having a circular cross section, and McBride having a narrow rectangular section, these devices would be prone to slipping off the edge of the roof. Perbix, would prevent the ladder side members of an extension ladder from sliding within one another when the ladder is shortened.

SUMMARY OF THE INVENTION

The present invention is directed to a load-dispersing device non-free-standing ladders, or other devices that require reduction of horizontal slippage. The device further reduces damage of delicate surfaces. The single strip load-dispersing bumper, can be used in combination with a ladder having side rails with a load bearing surface. The bumper consists of a pair of flexible, resilient, load-dispersing members, each of which has a contact area and a method of affixing the members to the ladder load bearing surface. The contact area has a width, a length, a first side and a second side, with the first side being placed adjacent, and secured to the load bearing surface. In some embodiments the first side has a recessed receiving area that is dimensioned to receive the load bearing surface. The second side of the contact area is placed between the load bearing surface and a support surface to prevent the ladder from sliding. The second side can have a flat, undulating, or other textured surface. The method of affixing the bumper to the load bearing surface can be through an adhesive, tape or hook and loop material. Alternatively, the bumper can be affixed to the ladder using multiple dome-topped pins that are integral with, and extend at right angles from, the first side of the contact area. The dome topped pins are dimensioned to fit within holes that are placed along the load bearing surface.

A retaining clip, dimensioned to encompass the second side of the contact area and at least a portion of the ladder side rails can be used to protect the end of the support member. The retaining clip is generally a C-shaped member manufactured from a semi-rigid material. Preferable the retaining clip is a soft metal having a body and a pair of parallel flanges extending from the body, for crimping around the side rails. The retaining clip can have a receiving notch within the body that has been dimensioned to receive the bumper end.

BRIEF DESCRIPTION OF THE DRAWINGS

FIG. 2 shows a transverse cross section of a single-strip bumper extending over only the bearing faces of the ladder;

FIG. 3 is an alternate embodiment of FIG. 2, having a configuration arranged to receive a portion of the ladder sides;

FIG. 4 shows a transverse cross section of a further embodiment with a channel to receive the ladder sides and is affixed to the ladder by chemical adhesive;

FIG. 5 illustrates the embodiment of FIG. 4 using an adhesive strip or hook-and-loop fastener;

FIG. 6 shows a transverse cross section of a single strip bumper that is affixed the ladder flanges by flexible dome-topped pins pushed through holes drilled in the ladder;

FIG. 7 shows a modification of FIG. 6 having a receiving channel;

FIG. 8 is a further embodiment of FIG. 2 used with a ladder having a semi-circular cross section;

FIG. 9 is an alternate embodiment to FIG. 3 in use with a ladder having a semicircular cross-section;

FIG. 18A is an exploded view of the spring clip of FIG. 18;

FIG. 23 is an exploded end view of interlocking bumper clip having a arched locking arms;

FIG. 24 is an end view of the interlocking bumper clip of FIG. 23 in the locked position;

FIG. 25 illustrates the clip of FIG. 24 having an alternate design in locking arms;

FIG. 26 illustrates the clip of FIG. 24 having a U-shaped and a S-shaped locking arms;

FIG. 26A illustrates the clip of FIG. 24 having small arched locking arms;

DETAILED DESCRIPTION OF THE PREFERRED EMBODIMENTS

This invention is directed to a load dispersing device for portable devices, such as ladders, that contact various structures. The purpose of the disclosed device is to prevent the ladder, or other device, from moving in relation to the support surface, while allowing for easy positioning.

Additionally, the support devices prevent damage to the support surface, such as gutters, window sills, etc.

The load dispersing devices as disclosed herein are manufactured from a force absorbing, cushioning material. Since during use the ladders will undergo transverse movement as the user climbs the ladder, and any material used must have sufficient strength to prevent tearing, permanent indentations, etc. The material is preferably soft and flexible, such as foam rubber or foam plastic, having a surface of a high coefficient of friction. The material requires sufficient density to transfer the load thrust of the ladder against the supporting surface to evenly distribute the load. In some end uses, it can be desirable that the material of manufacture provides electrical insulation between the ladder and the support surface. Although, for ease of description only one load dispersing device length, or clip unit, is illustrated, it should be understood that both sides of the ladder, or other device, should contain a device to maintain even distribution of weight.

Figure 1:
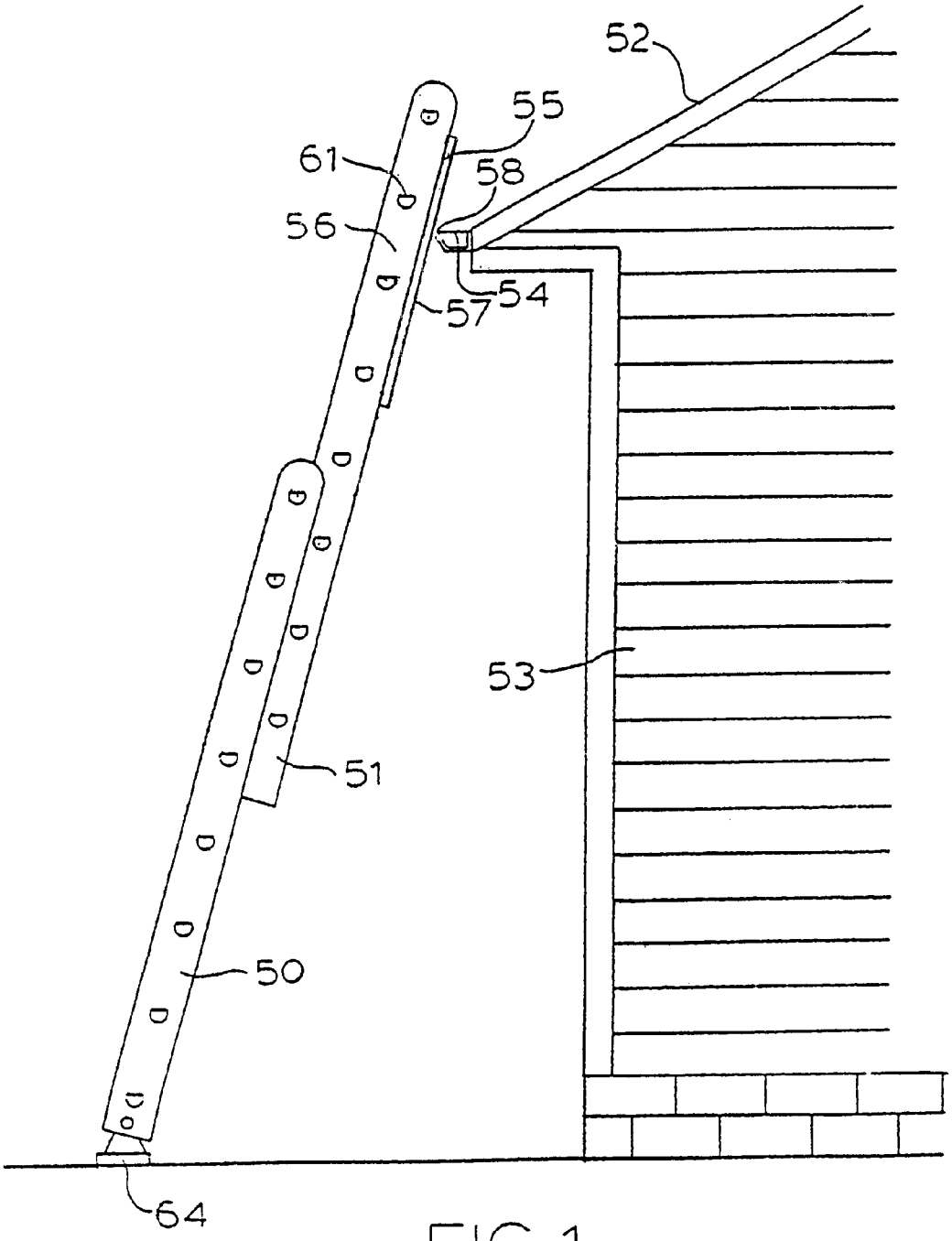
FIG. 1 is a side view of a ladder with fitted with the disclosed load-dispersing, single strip bumper.
Figure 10:
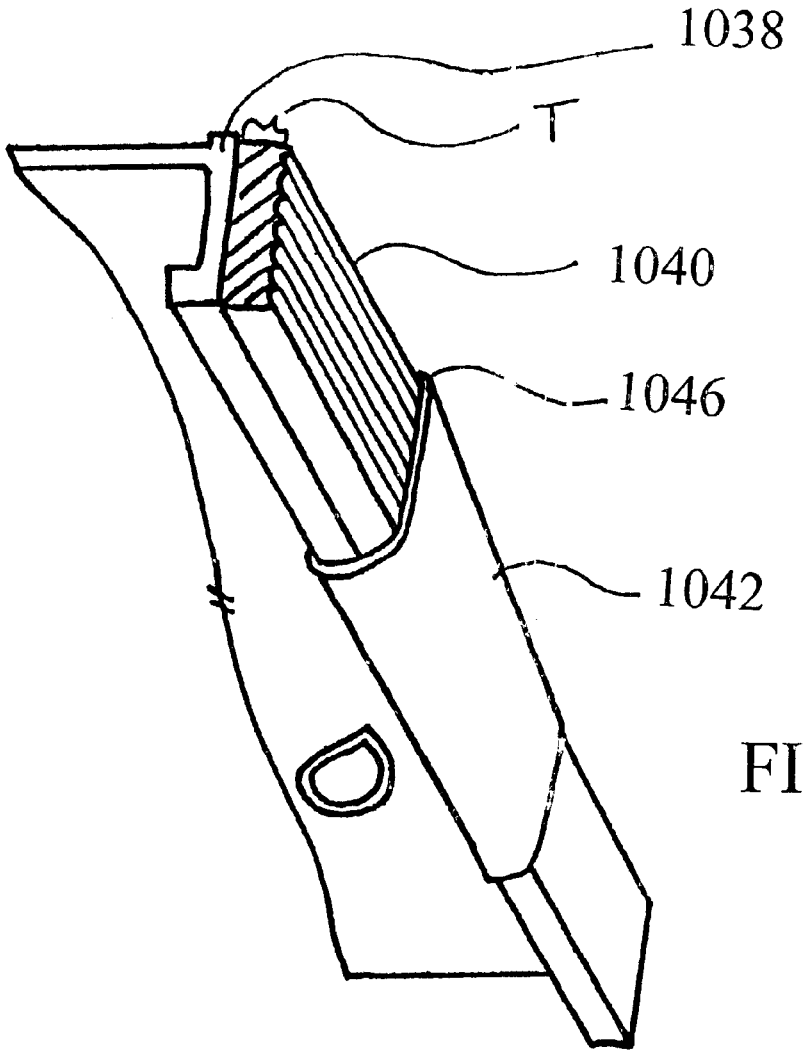
FIG. 10 is a perspective view of a single-strip bumper with a retaining clip.

Referring to the embodiments of this invention as shown in the drawings, FIG. 1 shows an extension ladder, comprising conventional lower stationary section 50 and upper ladder section 51. The upper ladder section 51 is placed against the gutter 54, to gain access to the roof 52 of the building 53. A generalized illustration of one length of the load-dispersing device 55, is disposed along the side members 56 and between the gutter 54 and the upper ladder section 51.

The load-dispersing device illustrated in FIGS. 1 through 14 are single-strips of material that have been affixed to the portion of the side member flange that rests between the ladder and the support surface. The single-strip bumpers can have the same patterned or unpatterned surface as taught in the parent applications and are manufactured from the same slip resistant material. The single-strip bumpers require less material, and in most embodiments can be used with ladder designs wherein the upper portion of the ladder slides within the lower portion. In order to facilitate this, the retaining clip 1042, described hereinafter, is used.

In FIG. 2 the single-strip bumper 84 has a rectangular transverse cross sectional shape and is adhered directly onto the ladder side member 86. The single-strip bumper 84 can be mounted onto the side member 86 though the use of any applicable adhesive or by other securing members as disclosed further herein. In FIG. 8 the rectangular configuration as disclosed in FIG. 2 is illustrated affixed to a ladder edge having a circular configuration. The single-strip bumper 91 is secured to the ladder 93 through use of any of the securing means 89, as disclosed herein.

In FIG. 3 the length 85 is provided with a recessed channel 88 dimensioned to receive the rectangular box-section ladder side member 87. The affixing means 83, as described, are used to maintain the length in position. In FIG. 9, the single-strip bumper 92 is affixed to a curved ladder side 94 through used of affixing means -90 within a channel.

In FIG. 4 the single-strip bumper 76 has a recessed channel 77 to receive the side member flange 80. The base 78 of the channel 77 is provided with a chemical adhesive 79 to maintain the length 76 adjacent to the flange 80. A similar example is shown in FIG. 5, wherein the bumper 83 is secured to the ladder flange 85 through use of an affixing member 81. The affixing member can be a double-sided adhesive strip, hook-and-loop fastener or other securing method other than adhesives.

FIGS. 6 and 7 illustrate embodiments in which the affixing means for lengths 103 and 104 are a longitudinal series of flexible dome-topped pins 101 and 102 respectively. The dome-topped pins 101 and 102 are attached along the flange contact surfaces 107 and 108. The dome-topped pins 101 and 102 are dimensioned to fit into corresponding holes 109 and 110 that are drilled in the respective flanges 105 and 106. The respective holes 109 and 110 each have a diameter equal to the minimum diameter portions 113 and 114 of the pins 101 and 102. The minimum diameter portions 113 and 114 have a length equal to the thickness of flanges 105 and 106. The holes 109 and 110 are drilled along the flanges 105 and 106 to match the spacing of the dome-topped pins 101 and 102. The flexibility of the domed tops 111 and 112 enable them to be pushed through the corresponding holes 109 and 110. Once pushed through, the domed tops 111 and 112 expand to lock the lengths 103 and 104 into longitudinal alignment along flanges 105 and 106.

The embodiment of the single strip bumper 1040, as illustrated in FIGS. 10–13, is dimensioned for use with ladders where the upper portion of the ladder recesses into the lower, overlying, portion. The bumper 1040 also illustrates the use of a non-flat surface, such as the example undulating surface in this figure. To enable the upper portion to recess, the bumper 1040 is manufactured with a width equal to, or slightly less than, the ladder flange 1038. The strip bumper 1040 is adhered to the flange 1038 through any means known in the art that will maintain the bumper 1040 close to the flange 1038 and will prevent pealing. In order to provide maximum cushioning and negate slippage, the thickness "T" of the bumper 1040 is greater than the space between the flange 1038 and the overlying ladder portion (not shown). To further protect the bumper 1040 while enabling the flange 1038 to be slid down into the lower portion of the ladder, the retaining clip 1042 is placed over the end of the bumper 1040. The retaining clips illustrated herein are generally C-shaped units that are mounted onto the flanges.

The retaining clip can be affixed to the ladder through a variety of method depending upon the material of manufacture. If the clip is manufactured from plastic, it can be opened by flexing the body, placed over the flange, and then released. This method of placement would be done after the single strip bumper is adhered to the ladder edge. Alternatively, the retaining clip can be slid onto the ladder edge, the single strip bumper placed on the ladder, and the retaining clip slid up, over the bumper, to maintain it in place. The most economical material and method of assembly is to manufacture the retaining clip from inexpensive metal and to crimp the clip onto the ladder once the bumper is installed.

Figure 11:
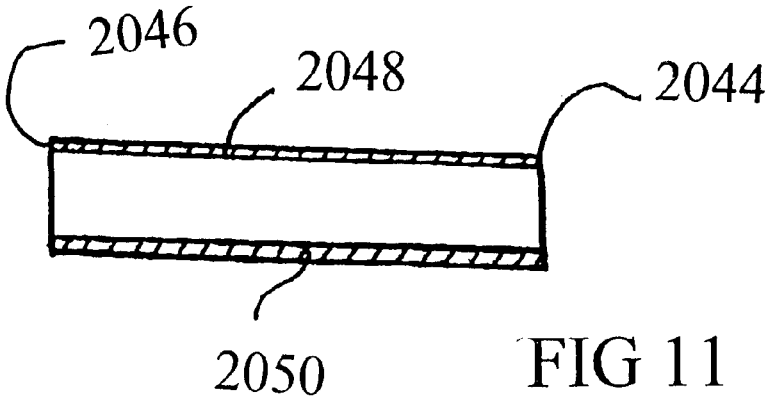
FIG. 11 is a cut away side view of an interior angled retaining clip for use with the single-strip bumper.
Figure 14:
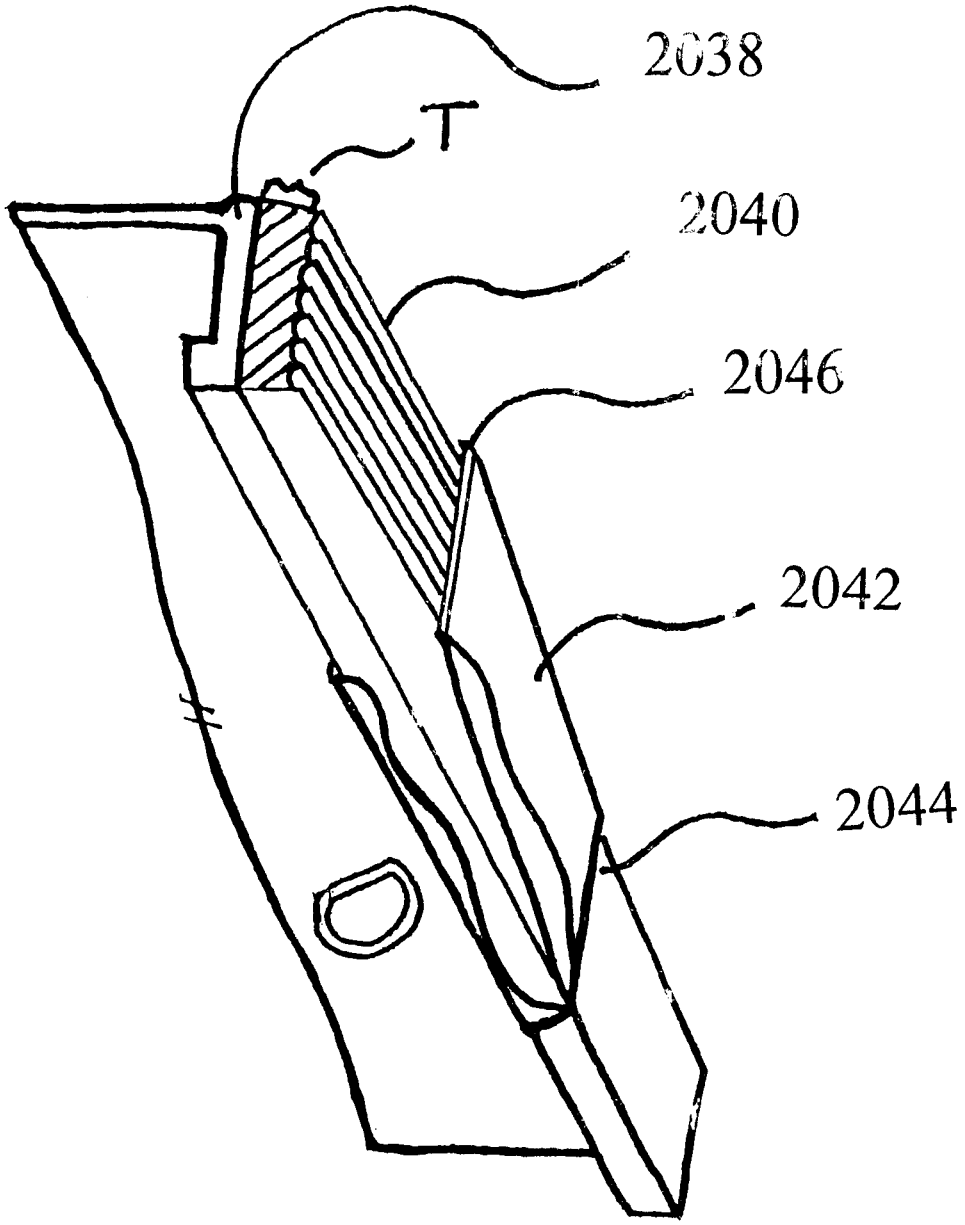
FIG. 14 is a perspective view of the single-strip bumper and retaining clip of FIG. 11.

As can be seen in the retaining clip 2042 of FIGS. 11 and 14, the interior and exterior of the retaining clip 2042 are angled to force the bumper 2040 to compress at the mating end 2044, a distance sufficient to enable the upper portion of ladder to slide into the overlying, lower portion. The upper end 2046 is designed with a distance between the exterior plate 2048 and the lower gripping edge 2050 equal to the combined thickness of the bumper 2040 and the ladder flange 2038, thereby enabling the bumper to be at its full thickness along the exposed surface.

Figure 12:
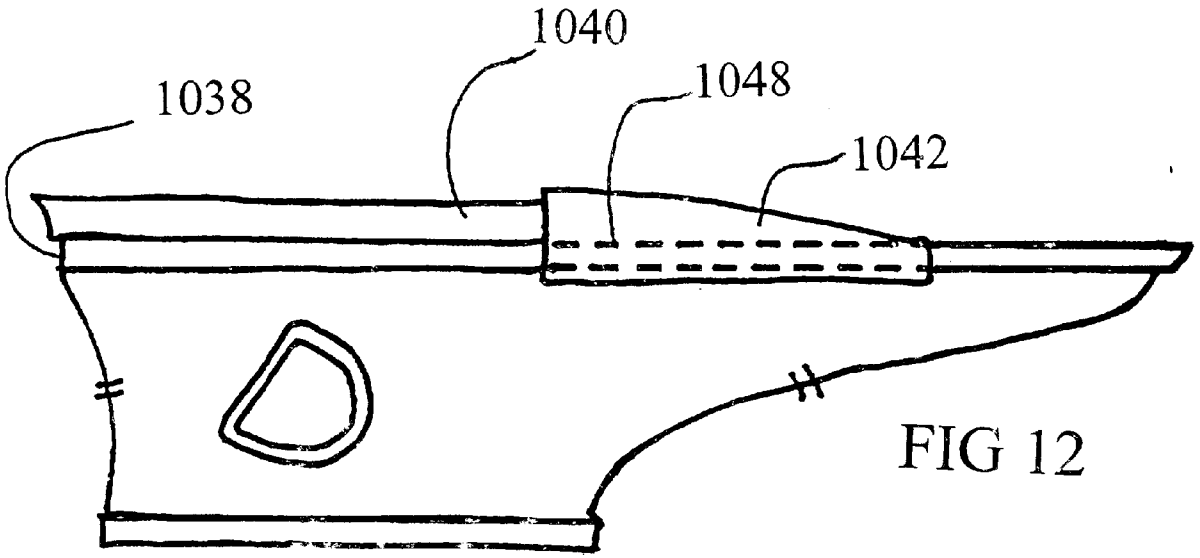
FIG. 12 is a side view of a single-strip bumper with an alternate retaining clip having a receiving notch.
Figure 13:
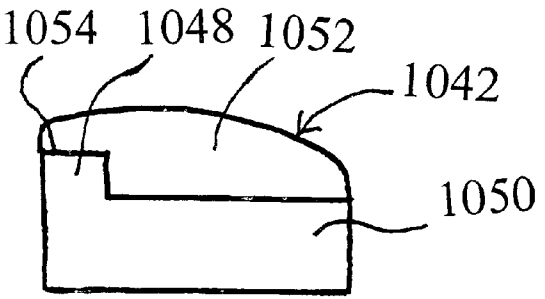
FIG. 13 is a cutaway side view of the retaining clip of FIG. 12.

In FIG. 12, the retaining clip 1042 has a receiving notch 1048 that is dimensioned to receive the single strip bumper 1040. To install the system, the bumper 1040 is placed onto the ladder edge 1038 and the retaining clip 1042 placed over the bumper 1040 end. As seen in FIG. 13, prior to placement on the ladder, the metal retaining clip body 1052 is formed with a lip 1054 to form the receiving notch 1048. The pair of legs, or flanges, 1050 extend parallel to one another, at right angles to the body 1052 to enable the flanges 1050 to be crimped around the ladder side rails. The receiving notch 1048 is dimensioned to receive the single strip bumper 1040, or equivalent embodiments. Recessing the notch 1048 within the body about ½ inch provides sufficient resistance to pealing, although different dimensions can be used depending upon final use and will be evident to those skilled in the art.

In some embodiments, where necessary due to the ladder fully recessing within the lower, overlying portion, the thickness T of the bumper 1040, combined with the thickness of the retaining clip, must be slightly less than the distance between the ladder flange 1038 and the overlying portion (not shown) to enable the ladder flange 1038 to fully recess without tearing the material. In ladders that are manufactured with the upper portion being longer than bottom portion, the thickness of the single strip bumper is not as critical, since it will not come in contact with the lower portion of the ladder.

Although only two surface configurations, the smooth and undulating are illustrated, any surface configuration, as disclosed in the foregoing parent application, can be used in the single strip bumper The load dispersing devices disclosed in FIGS. 15–28 are two piece clip units which extend along a portion of the length of the ladder. The dimensioning, as far as length and contact surface are, as with the foregoing embodiments, dependent upon end use.

Figure 15:
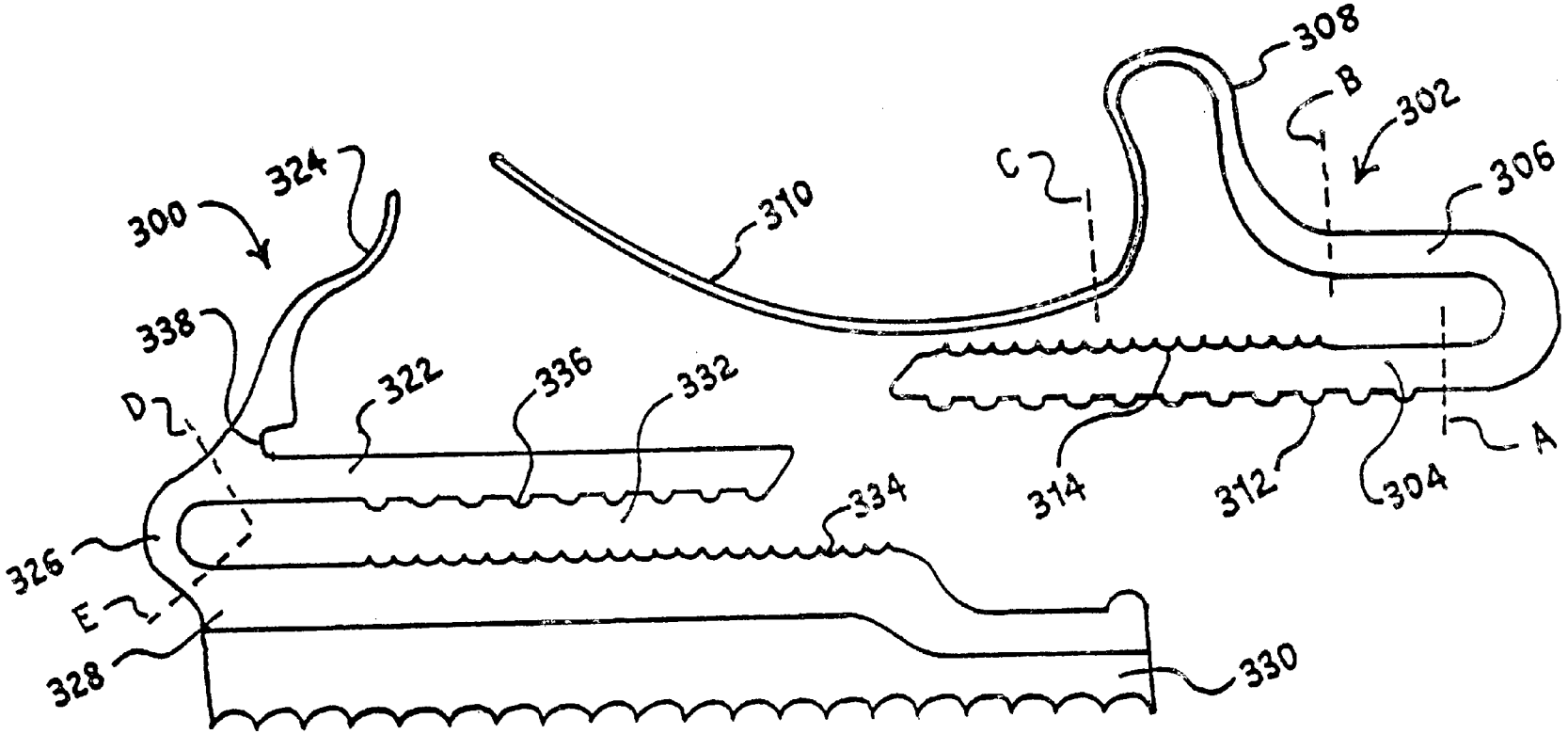
FIG. 15 is an exploded end view of the disclosed two piece bumper clip.
Figure 16:
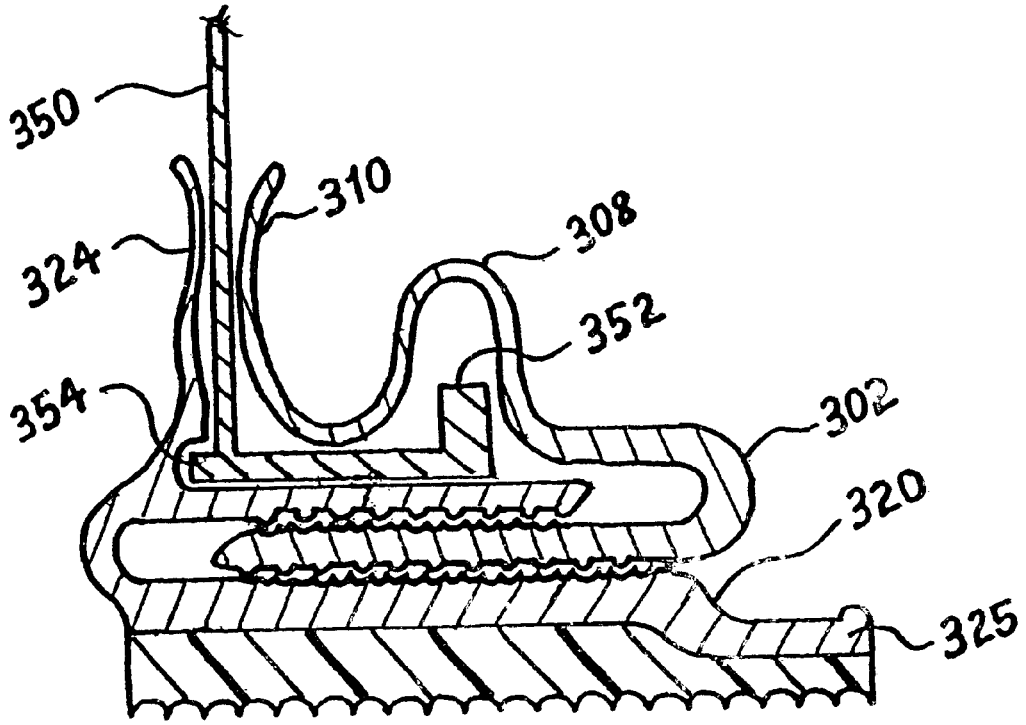
FIG. 16 is a cutaway end view of the two piece clip of FIG. 15 placed on a L-shaped ladder having a lip and heel.
Figure 17:
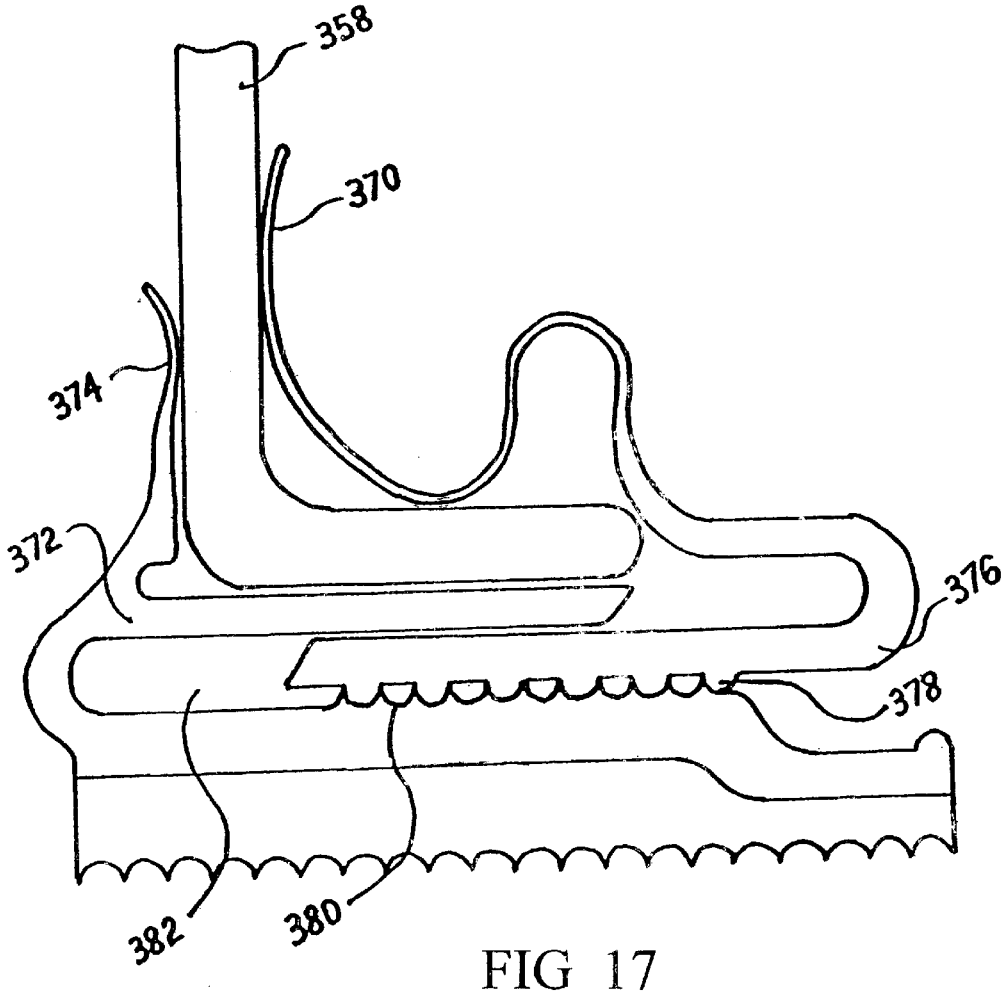
FIG. 17 is a cutaway end view of the two piece clip of FIG. 15 placed on a L-shaped ladder.

The clip unit 300 as shown in FIGS. 15, 16 and 17 is a two piece unit which snaps around the ladder side 350 of FIG. 16 and ladder side 358 of FIG. 17. Due to the intricate shape of the clip unit 300, the clips 302 and 320 have been divided by lettered lines into sections. It should be noted that these sections are used for ease of description only and that they are not, in any way, intended to reflect on means of manufacture or to limit the scope of the invention.

As easily seen in FIG. 15, the clip unit 300 consists of a male locking clip 302 and a female bumper clip 320, which interlock through the interaction between a toothed flange 304 and toothed channel 332. The locking clip 302 has a flange 304 that is, in this embodiment, provided with teeth 312 along one outer surface and tooth receiving indents 314 along the opposite outer surface. The locking body 306 of the locking clip 302, defined as the area between dividing line A and dividing line B, is curved in a U-shape. From the locking body 306 extends the frame arc 308, defined between dividing lines B and C, which then extends into the spring lock 310, extending from dividing line C to the end. The locking body 306 and flange 304 are relatively rigid sections and have a heavier gauge than the frame arc 308 and spring lock 310. During operation, the locking body 306 and the flange 304 both need to remain in a generally fixed position. Some flexibility is optimal to prevent breakage, however most heavy-duty plastics provide the necessary flexibility. Too much flexibility weakens the unit and diminishes the locking capabilities. The frame arc 308 and spring lock 310 have a thinner cross-sectional width to allow for the creation of a spring action. The material used for the clip unit 300 should have memory, and is especially important in the frame arc 308 and the spring lock 310. In the preferred embodiment the locking clip 302 and the bumper clip 320 are manufactured from one material, although more than one material can be used.

The purpose of the spring lock 310 and frame arc 308 is to prevent movement of the locking clip 302 within relation to the ladder side 350 or ladder side 358. The frame arc 308 serves a dual purpose, first to provide clearance for the lip 352 of the ladder and second to enhance the spring affect.

The bumper clip 320 is the mating, female portion, of the clip unit 300. The bumper base 328 provides a surface for the attachment of the bumper 330 on one linear surface and toothed indents 334 on the opposite linear surface. The bumper base 328 illustrated is curved at the open end to create finger grip 323 for releasing the flange 304 from the bumper clip 320. By pulling down on the finger grip 323, the bumper base 328 is pulled away from the flange 304, releasing the interlocking means and allowing the flange 304 to be removed from the channel 332. The bumper base 328 curves to form a U-shape, as indicated at bend 326 between dividing lines D and E. This allows the upper body 322, in combination with the bumper base 328, to form the toothed channel 332. The locking flange 324 extends at approximately a 45 degree angle from the surface of the upper body 322. The locking flange 324 has a cross-sectional width less than that of the upper body 322 to allow for flexibility. A notch 338 is provided at the connection point between the upper body 322 and the locking flange 324 to accommodate the configuration illustrated as ladder side 350. The flange 324 provides the opposite lateral locking action to the spring lock 310, thereby preventing any lateral movement of the clip unit 300 when affixed to the ladder sides 350 or 358.

Although the teeth 336 are illustrated as part of the upper body 322 and the toothed indents 334 are part of the bumper base 328, the placement is not critical. The critical feature is that the teeth and toothed indents of the bumper clip interact with the teeth and toothed indents of the locking clip. Therefore, the placement and configuration of the design shown is for illustration purposes only and any spacing, arrangement or configuration can be incorporated and will be apparent to those skilled in the art.

The locking clip 302 and bumper clip 320 are illustrated placed on ladders 350 and 358 in FIGS. 16 and 17. The ladder 350 is a L-shape with a heel 354 and lip 352. As stated heretofore, the 308 serves not only to provide for the tension action required to maintain the clip unit 300 in place, but to provide clearance for the lip 352 when required. Although the notch 360 is not required when the unit 300 is used with the configuration of ladder 358, it is required to accommodate the heel 354 of ladder 350. As can be seen from FIGS. 16 and 17, the locking flange 324 and spring lock 310 serve to lock the clip unit 300 in place. By retaining memory, the combination of the spring lock 310 and the frame arc 308 place pressure against the ladder 350 and 352. On the opposite side of the ladder web, the flange 354 applies pressure to return to its approximately 45 degree angle rather than the 90 degree angle into which the flange 354 is forced when attached to the ladder 350. Thus, the pressure created by the flange 324 and the spring lock 310 on either side of the ladder web prevents any side-to-side movement of the clip unit 300. The clip unit 300 is prevented from movement along the length of the ladder 350 by the pressure exerted by spring lock 310 and frame arc 308.

By providing a number of teeth and receiving ridges along the toothed channel 332 and the toothed flange 304, adjustability is provided. The flange 304 is inserted into the channel 332 until the flange 324 comes in contact with the ladder web on one side and the lip or flange of the ladder comes in contact with the locking body 306. This provides the adjustability for the clip unit 300 to be used with ladders having various sized flanges as well as various configurations.

In FIG. 17, although the same basic configuration as FIGS. 15 and 16, the teeth on both the upper body 372 and the flange 376 have been modified. The upper body 372 is a smooth surface that mates with the smooth upper surface of the flange 376. The lower surface of the flange 376 is provided with ridges 378, such as teeth, undulations or any other interlocking configuration known in the art. The lower portion of the toothed channel 382 is provided with interacting receiving notches 380 which interact with the ridges 378 of the flange 376.

As illustrated the bumper 330 and the bumper base 328 are different materials and can either be extruded together at time of manufacture or adhered at a later date. The bumper 330 can, in some instances, be manufactured from the same material as the remaining portions of the clip unit 300, depending upon the end use.

Figure 18:
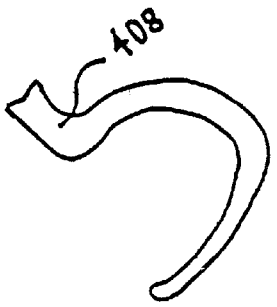
FIG. 18 is a cutaway end view of the two piece bumper clip having mirror image spring locking devices.
Figure 18:
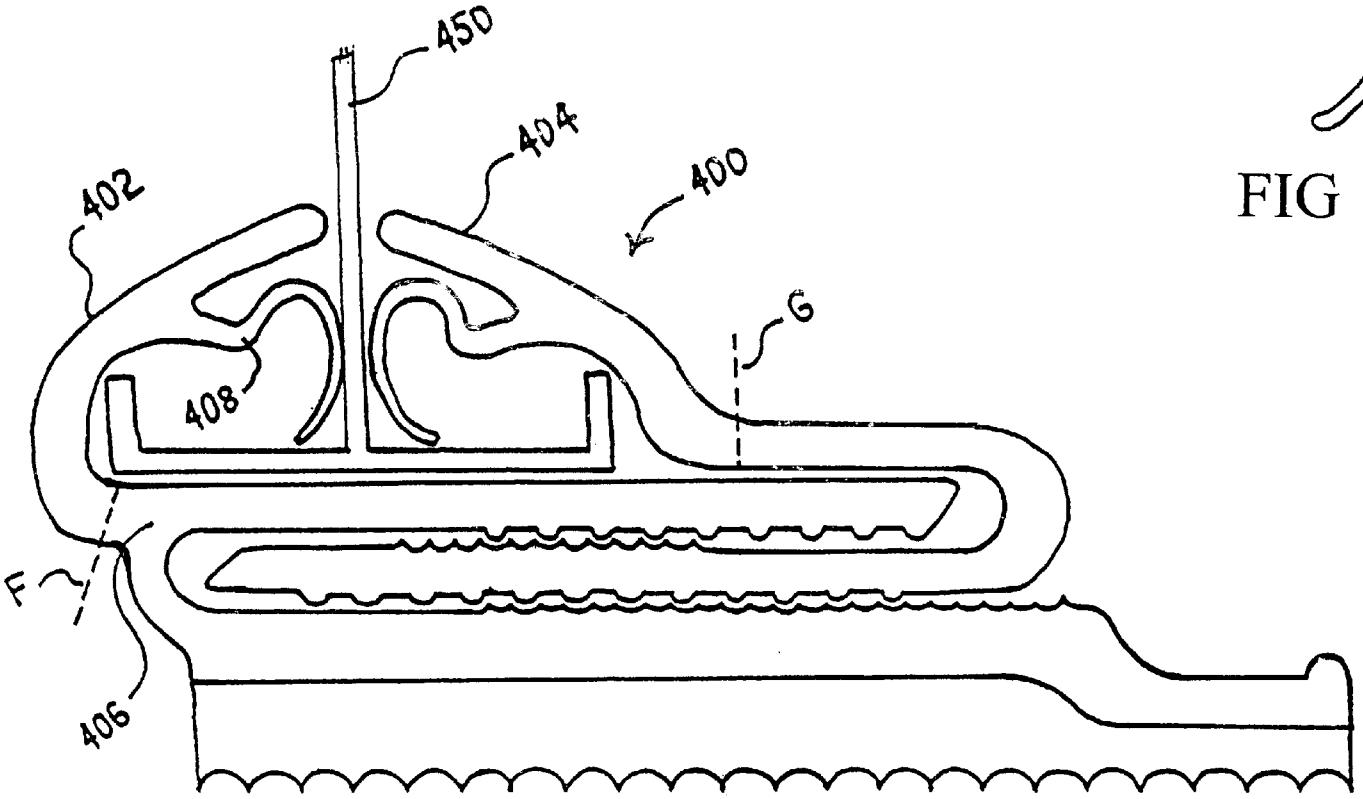
Figure 19:
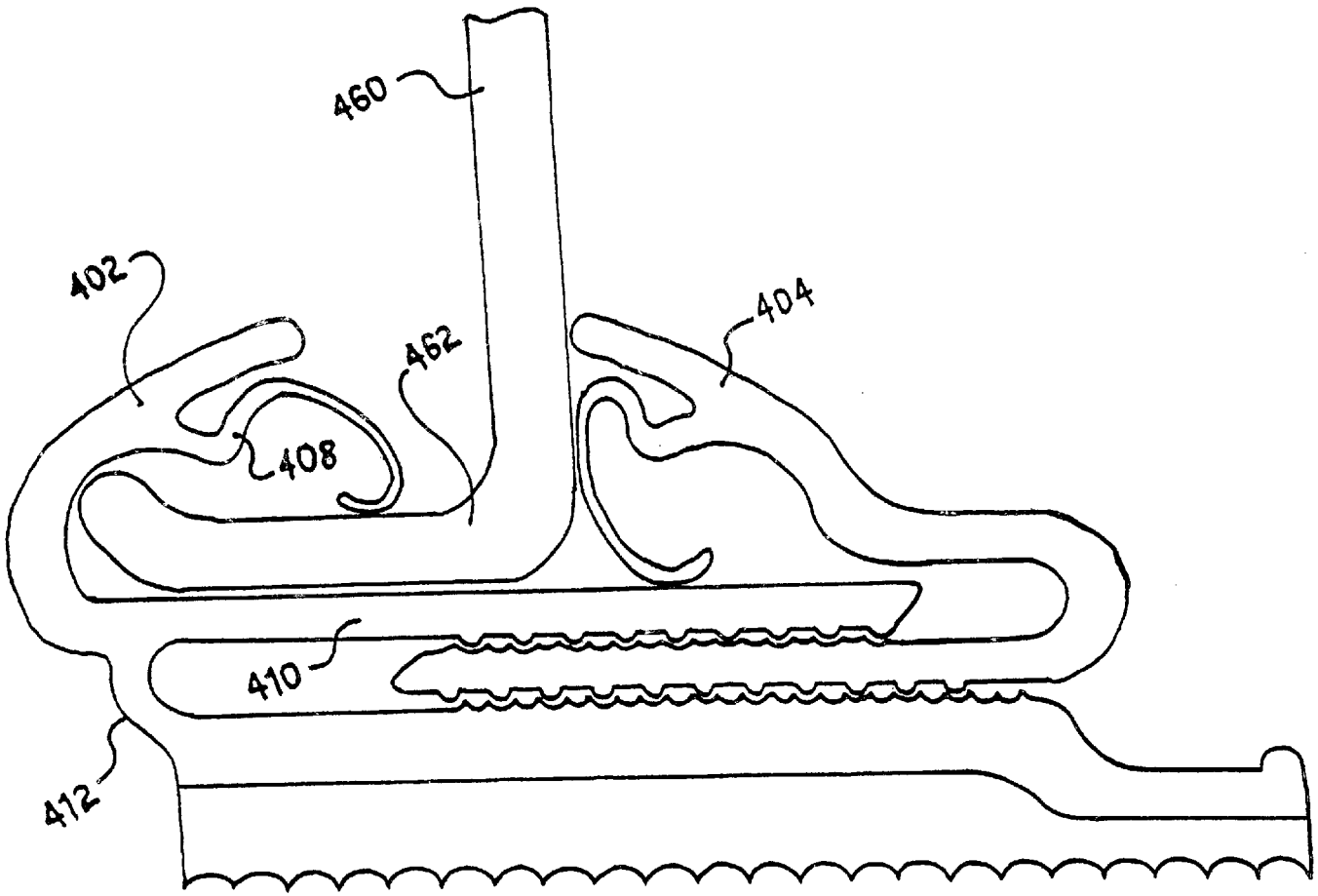
FIG. 19 is a cutaway end view of the clip of FIG. 18 used with a L-shaped ladder.

FIGS. 18, 18A and 19 illustrate the clip unit 400 used on a ladder 450 with a T-shaped configuration and a ladder 460 with a L-shaped configuration. The clip unit 400 is manufactured basically the same as the clip unit 300, except for the locking arms. The flange 324, frame arc 308 and spring lock 310 have been replaced with flange locks 402 and 404. For purposes of description, flange lock 404 begins at dividing line G and flange lock 402 begins at dividing line F. The flange lock 402 extends and curves from the female clip body 406 in approximately a quarter circle. A hook lock 408 extends from the flange lock 402, extending toward the female clip body 406. The hook lock 408 works in the same theory as the spring lock 310. The hook lock 408 is illustrated separately in FIG. 29A, more clearly showing the larger arc. The pressure created by confining the hook lock 408 to the confined space of the ladder 450 maintains the clip unit 400 in place. The hook lock 408 can be identical on both sides, or dependent upon end use, one side can be designed to create less tension. The flange lock 404, as designated by dividing line G, is designed slightly differently to accommodate use with the T shaped ladder 450. The illustrated curve is used for example and can be modified, or eliminated, depending upon end use.

As seen in FIG. 19, the flange locks 402 and 404 can be used with the L-shape ladder 460 due to the slight flexibility of the flange locks 402 and 404. The length of the hook locks 408 must be sufficient to come in contact with the ladder flange 462 even with the angle increase between flange locks 402 and 404 and the upper base 410 of the female clip 412. Although the flexibility of the hook locks 408 and the flange locks 402 must allow for the variations in size of the ladder flanges, they must maintain memory of their original position. This memory creates, as described heretofore, the pressure required to resist the movement of the bumper clips disclosed herein in relation to the ladder sides.

Figure 22:
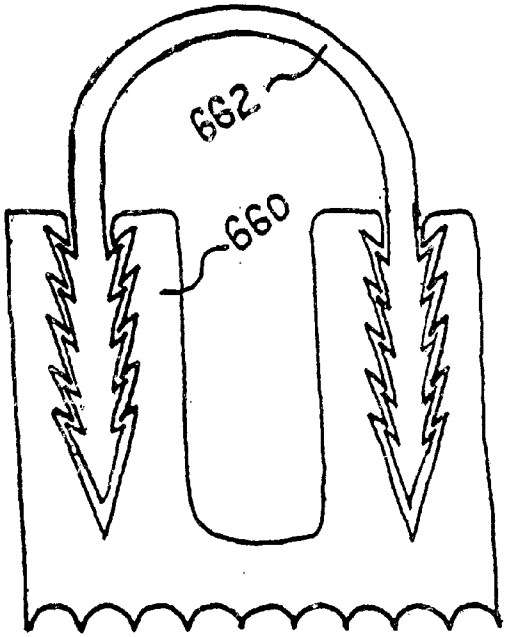
FIG. 22 is a cutaway end view of a U-shaped locking clip having alternate locking ridges and a single material construction.
Figure 21:
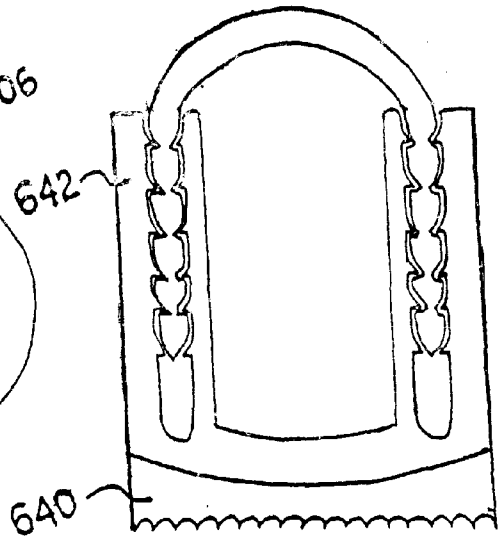
FIG. 21 is a cutaway end view of a U-shaped locking clip having a single bumper.
Figure 20:
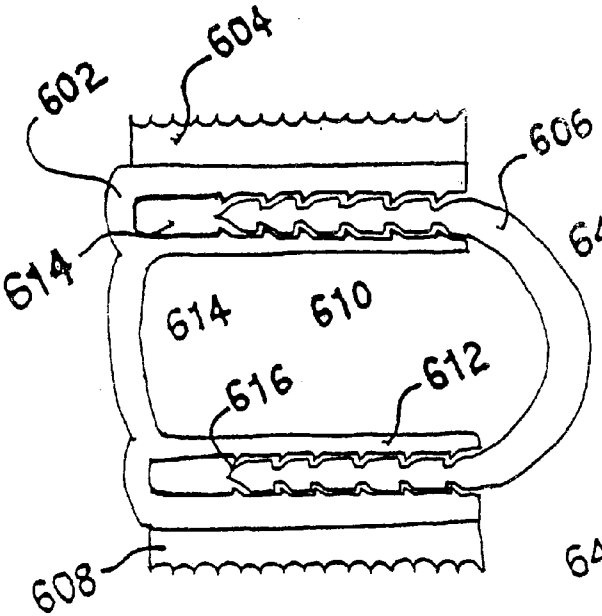
FIG. 20 is a cutaway end view of an alternate embodiment using a U-shaped locking clip and dual bumpers.

FIGS. 20–26 illustrate alternate embodiments of the device disclosed heretofore. In FIG. 20, the bumper body 602 is a U-shaped device with bumpers 604 and 608 along both legs 610 and 612. The center of the legs 610 and 612 is provided with notched receiving channels 614 and 616 to receive, and retain, the U-lock 606. The U-lock is provided with notches which correspond to the notches within the receiving channels 614 and 616. The clip of FIG. 21 is essentially the same design as disclosed in FIG. 20, however, the bumper 640 is at the bottom of the U-shaped device 642. In FIG. 22, a different notch arrangement is utilized between the U-shaped device 660 and the U-lock 662. Additionally, the U-shaped device 660 has no separate bumper, but rather is manufactured from a material that can also serve as a protective bumper unit.

The bumper clip 700 as illustrated in FIGS. 23 and 24 are designed for use with various surfaces, such as automobile roof racks, which require protection. The clip 700 consists of a female receiving clip 720 and a male locking clip 722. The receiving clip has a U-shaped body 704, the interior of which is ridged with teeth 712. A bumper 702 is affixed to one side of the U-shaped body 704 along the length. A curved locking section 706 extends at approximately 45 degrees from the body 704 opposite the bumper 702. The male locking clip 722 consists of a ridged locking flange 708 and curved locking section 710. The dimensions of the locking flange 708 are dimensioned to fit within the interior of the U-shaped body 704 and interact with the teeth 712. When assembled, as illustrated in FIG. 24, the locking section 706 and locking section 710 overlap, forming a half circle.

In the embodiments illustrated in FIGS. 25, 26, 26A the locking sections have been modified as examples of possible configurations. These illustrations are not intended to limit the possible designs of the locking sections, but rather to demonstrate examples of the possible modifications. In FIG. 25 the locking sections 752 and 754 of the clip 750 are designed in a modified S-shaped curve. In FIG. 26, the clip 770 is designed with locking section 772 and 774 having different configurations. The locking section 772 is-formed in an L shape, with the leg 778 extending at approximately right angles from the body 776 and brace 772 running parallel to the body 776. The locking section 774 is a modified S, extending at approximately right angles to the body 776. In FIG. 26A, the locking sections 802 and 804 of the clip 800 extend at approximately right angles to the body 806, forming an approximate quarter circle.

Figure 27:
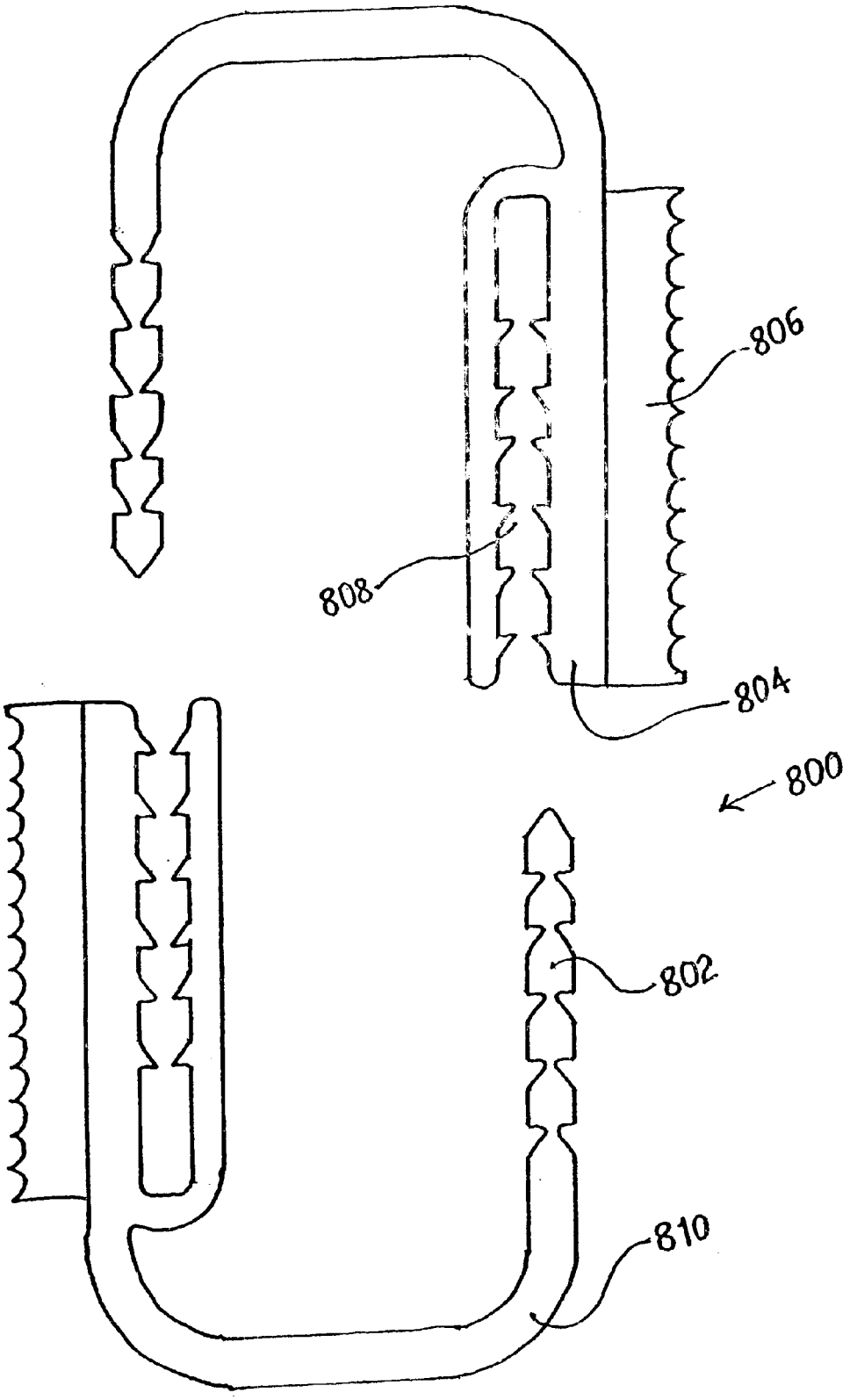
FIG. 27 is an exploded side view of a mirror image clip.
Figure 28:
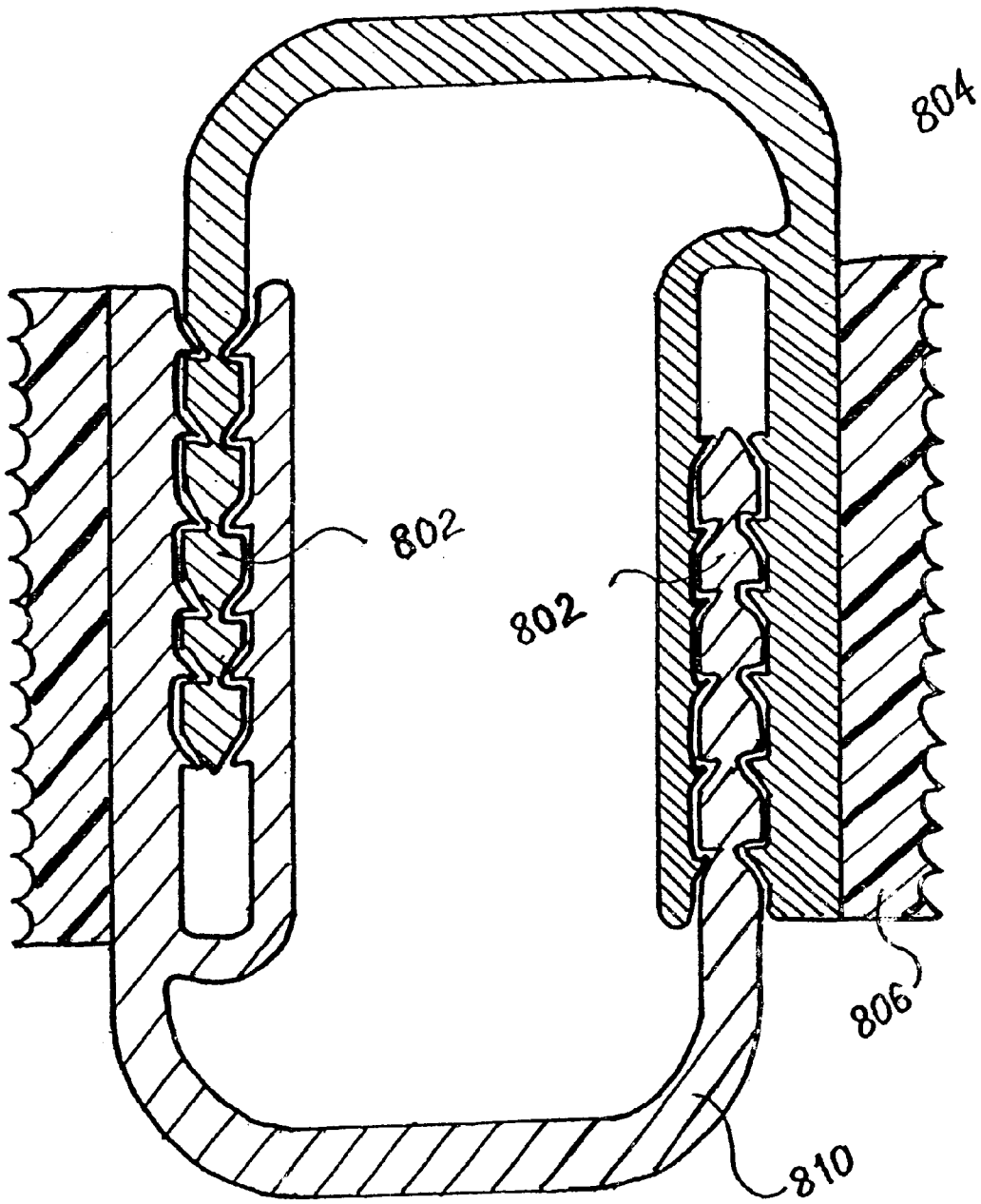
FIG. 28 is a side view of the clip of FIG. 27 assembled.

In FIGS. 27 and 28 an alternate to the foregoing clips is disclosed wherein a bi-clip unit 800 consists of two bi-clips 804 and 810. Each of the U-shaped bi-clips 804 and 810 contains a ridged male unit 802 and a complementary ridged female unit 808. A bumper 806 is affixed on the outside surface proximate the female unit 808. The unit 800 is interlocked as illustrated in FIG. 28, by inserting the male unit 802 of clip 810 into the female unit 808 of clip 804, thereby creating an oblong unit with bumpers 806 on opposite exterior sides. Although the configuration illustrated in FIG. 28 is a modified oblong with bumpers 806 on each side, the configuration can be altered according to end use. Modifications to the illustrated basic design can include a bumper on only one side, a more circular or rectangular unit, curved rather than angular ridges, as well as other modifications which will become apparent to those skilled in the art.

Figure 29:
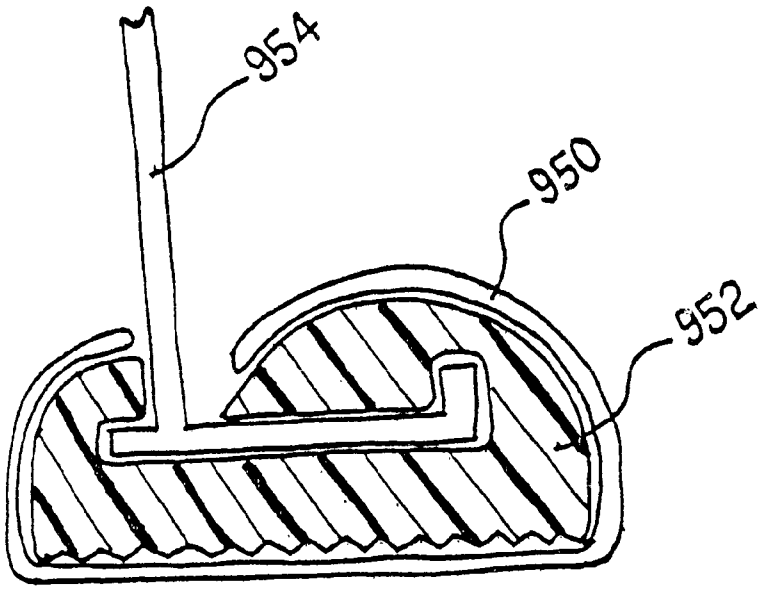
FIG. 29 is a side view of the exterior clip for securing a soft bumper.

In FIG. 29, a soft bumper 952 is provided that completely wraps around the ladder flange 954. The soft bumper 952 has no structural support in of itself and requires a bumper clip 950 to maintain the soft bumper 952 on the flange 954. The bumper clip 950 does not extend the length of the bumper 952 and serves as a retaining unit only. A bumper clip 950 would be placed approximately every 8–16 inches, depending upon the rigidity of the soft bumper 952.

Figure 30:
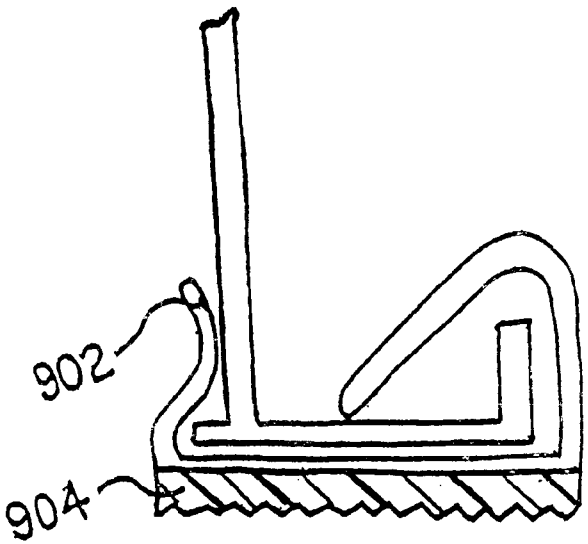
FIG. 30 is a side view of a stiff, flexible clip with a soft bumper attached.

In FIG. 30 a flexible clip 902 is manufactured with the bumper 904 adhered directly onto the base of the clip 902. The flexible clip 902 is manufactured in the approximate configuration of a ladder flange in order to allow the clip 902 to be used with most ladders. The plastic, or other material, used to manufacture the clip 902 must be resilient semi-rigid plastic that allows for the clip to be opened, without breakage, for placement or removal. The clip 902 must have sufficient memory and rigidity to return to its original configuration once it is released.

Although the illustrations and descriptions herein are describing use on sliding ladders, it should be noted that any type of ladder or other device that rests against a surface could utilize the disclosed load bearing devices. For example, the disclosed single strip bumper, using an adhesive backing, can be placed on the undersides of emergency ladders that are placed over the window sill. The single strip bumper prevents horizontal movement between the ladder and the window sill while a person is climbing through the window and down the ladder. Further, the device can be used to protect the surface of an object from being struck by other objects. This can include such uses as preventing shopping carts from striking store walls or the backs of furniture from coming in contact with the walls.

The foregoing bumper clips serve to affix a protective device onto a three dimensional object. The use of a protective bumper surface, attaching means and interlocking means provides a unique method of permanently, or temporarily, providing protection for an object. Although some embodiments disclosed are designed for particular use with ladders, the bumper clips can also be used with railings, pipes, stair treads, doors counter tops, small and large appliances, exercise equipment, tool handles, sporting equipment, fencing, office equipment, electronic equipment and power tools. The clips can further be used as weather stripping or a protective strip on various locations of lawn and garden, automotive, industrial and agricultural equipment.

The appended drawings show various modes of construction and installation of the load dispersing device for portable ladders which is the subject of the present invention, in order, together with this written description, to indicate to those skilled in the art how this invention achieves its objects of reducing damage and slipping in the use of any portable, non-free-standing ladder, while at the same time facilitating rather than restricting the adjustment of the ladder into the necessary operating position. Any and all combinations of such modes are intended to fall within the scope of this invention, as particularly set forth in the appended claims. Furthermore, the foregoing description of the invention has been directed to a particular preferred embodiment in accordance with the applicable statutes and for the purposes of explanation and illustration. It will be apparent to those skilled in the art that modifications and changes in the specifically described device may be made within the scope and true spirit of the invention in addition to alternative versions of the preferred embodiment described above. It is the applicants' intention in the following claims to cover such modifications and changes.

What is claimed is:

1. A load-dispersing device in combination with a ladder, said ladder having side rails, each of said side rails having an entire length thereof with which a load bearing surface extends, and said side rails being separated by rungs, said rungs being in contact with said side rails, said load-dispersing device comprising:

a pair of flexible, resilient, load-dispersing members, each of said pair of load-dispersing members having:

a contact area, said contact area having a width, a length, a first side and a second side, affixing means, said affixing means being along said length of said first side of said contact area, wherein, said affixing means maintains said load-dispersing members adjacent said load bearing surface, and said second side of said contact area placed between said load bearing surface and a support surface prevents said ladder from sliding; and wherein, said load-dispersing members are affixable to any point along a length of said load bearing surface.

2. The load dispersing device of claim 1 wherein said affixing means is an adhesive.

3. The load dispersing device of claim 2 wherein said adhesive is a double sided tape.

4. The load dispersing device of claim 2 wherein said adhesive is a hook and loop material.

5. The load dispersing device of claim 1 wherein said affixing means are multiple dome-topped pins, said dome-topped pins being integral with, and extending at right angles from, said first side of said contact area, said dome topped pins being flexible and dimensioned to fit within holes placed along said load bearing surface.

6. The load dispersing device of claim 1 wherein said contact area has an undulating surface.

7. The load dispersing device of claim 1 wherein said contact area first side further comprises a recessed receiving area along said length, said recessed receiving area being dimensioned to receive said load bearing surface.

8. The load dispersing device of claim 1 further comprising a retaining clip, said retaining clip being dimensioned to encompass said second side of said contact area and at least a portion of said ladder side rails.

9. The load dispersing device of claim 8 wherein said retaining clip is C-shaped.

10. The load dispersing device of claim 8 wherein said retaining clip is a semi-rigid material.

11. The load dispersing device of claim 8 wherein said retaining clip is a soft metal having a body and a pair of parallel flanges extending from said body, said parallel flanges being crimped around the side rails.

12. The load dispersing device of claim 11 further comprising a receiving notch within said body, said receiving notch being dimensioned to receive said load dispersing device.

13. A load-dispersing device in combination with a ladder, said ladder having an upper portion and a lower portion in slidable engagement, said upper portion sliding within said lower portion, said upper portion and said lower portion each having side rails, said side rails having a length and a load bearing surface, and being separated by rungs, said rungs being in contact with said side rails, said load dispersing device comprising:

a pair of flexible, resilient, load-dispersing members, each of said pair of load-dispersing members having:

a contact area, said contact area having a width, a length, a first side and a second side, affixing means, said affixing means being along said length of said first side of said contact area, a retaining clip, said retaining clip being dimensioned to encompass said second side of said contact area and at least a portion of said ladder upper portion side rails, said retaining clip having a first end and a second end, an exterior surface and a securing surface, a distance between said first end exterior surface and said first end securing surface being greater than a distance between said second end exterior surface and said second end securing surface, wherein said affixing means maintains said load-dispersing members adjacent said load bearing surface, and said second side of said contact area placed between said load bearing surface and a support surface prevents said ladder from sliding along said support surface and said retaining clip enables said upper portion to slide within said lower portion without damaging said load dispersing member, and wherein, said load-dispersing members are affixable to any point along a length of said load bearing surface.

14. The load dispersing device of claim 13 wherein said affixing means is an adhesive.

15. The load dispersing device of claim 13 wherein said affixing means are multiple dome-topped pins, said dome-topped pins being integral with, and extending at right angles from, said first side of said contact area, said dome topped pins being flexible and dimensioned to fit within holes placed along said load bearing surface.

16. The load dispersing device of claim 13 wherein said contact area has an undulating surface.

17. The load dispersing device of claim 13 wherein said contact area first side further comprises a recessed receiving area along said length, said recessed receiving area being dimensioned to receive said load bearing surface.

18. A method of preventing horizontal slippage of a ladder, said ladder having a first portion and a second portion in slidable engagement with one another, said first portion and said second portion each having a pair of side rails, each of said side rails having an entire length thereof with which a load bearing surface extends, and said side rails being separated by rungs, said rungs being in contact with said side rails, said load-dispersing device having a pair of flexible, resilient, load-dispersing members affixable to any point along a length of a respective one of said load bearing surfaces of said first portion of said ladder, each of said pair of load-dispersing members having a contact area, said contact area having a width and a length and affixing means, said affixing means being proximate said contact area, comprising the steps of:

exposing said affixing means of a first of said load-dispersing members, placing said contact area of a first of said load-dispersing members adjacent to a first of said load bearing surfaces;

securing said first load-dispersing member to said first load bearing surface by applying pressure to a length of said first load-dispersing member, exposing said affixing means of a second of said load-dispersing members, placing said contact area of said second load-dispersing member proximate a second of said load bearing surfaces;

securing said second load-dispersing member to said second load bearing surface by applying pressure to a length of said second load-dispersing member, wherein affixing said contact area of each of said load-dispersing members to each of said load bearing surfaces maintains said load-dispersing members adjacent said load bearing surfaces and places said load-dispersing members between said load bearing surfaces and a support surface, thereby preventing the ladder from sliding in relation to the support surface.

19. The method of claim 18 further comprising the step of protecting said load-dispersing members' ends placed on a first portion of said ladder from contacting said second portion of said ladder using a retaining clip, said retaining clip dimensioned to encompass said second side of said contact area and at least a portion of said ladder upper portion side rails, said retaining clip having a first end and a second end, an exterior surface and a securing surface, a distance between said first end exterior surface and said first end securing surface being greater than a distance between said second end exterior surface and said second end securing surface comprising the step of placing said retaining clip over said load-dispersing members' end, thereby compressing said loading-dispersing member to enable said first portion of said ladder to slide within said second portion.

20. A single-strip bumper in combination with a device having an entire length thereof with which a load bearing surface extends, said bumper comprising:

at least one resilient, load-dispersing member having:

a contact area, said contact area having a width, a length, a first side and a second side, affixing means, said affixing means being along said length of said first side of said contact area, wherein said affixing means maintains said load-dispersing member adjacent said load bearing surface, and said second side of said contact area placed between said load bearing surface and a support surface prevents said device from sliding, and wherein, said at least one load-dispersing member is affixable to any point along a length of said load bearing surface.

* * * * *